US005954061A

United States Patent [19]

Cardarelli

[11] Patent Number: 5,954,061

[45] Date of Patent: Sep. 21, 1999

[54] CIGARETTE AERATION AND FILTRATION DEVICE

[76] Inventor: Venanzio Cardarelli, 20 N. Triangle Dr., Plymouth, Mass. 02360

[21] Appl. No.: 09/170,256

[22] Filed: Oct. 13, 1998

Related U.S. Application Data

[60] Provisional application No. 60/069,229, Dec. 11, 1997.

[51] Int. Cl.[6] ..... A24D 1/04; A24D 3/00; A24F 7/00

[52] U.S. Cl. ..... 131/363; 131/336; 131/339; 131/361; 131/201; 131/202; 131/227

[58] Field of Search ..... 131/201, 202, 131/227, 229, 331, 335, 336, 339, 361, 363

[56] References Cited

U.S. PATENT DOCUMENTS

| | | | |
|---|---|---|---|
| 3,756,249 | 9/1973 | Selke et al. . | |
| 3,773,053 | 11/1973 | Stephens . | |
| 3,774,622 | 11/1973 | Steigenwald . | |
| 3,905,377 | 9/1975 | Yatrides . | |
| 4,856,540 | 8/1989 | Jansma et al. | 131/339 |
| 4,877,040 | 10/1989 | Jansma et al. | 131/339 |
| 4,972,856 | 11/1990 | Sergio . | |

*Primary Examiner*—Stanley S. Silverman
*Assistant Examiner*—Michael P. Colaianni
*Attorney, Agent, or Firm*—D. Michael Burns

[57] ABSTRACT

A device comprising a filter and a rod which is capable of insertion into a cigarette cord that has a preformed conduit extending concentrically along the longitudinal axis of the cord. The rod having a plurality of perforations along its entire length, allowing for a fresh air supply to be sucked into the rod and then intermingled through the tobacco. The filter being available in various numbers of filtering ring elements which allow for a selection of filtering strength. The device is made of materials that would allow it to be reusable. As the cigarette cord burns down, the increased supply of fresh air will result in a reduction in the percentages of particulate matter (tars, nicotine,etc). By varying the number of filters, the taste will selectively be controlled by the user.

20 Claims, 2 Drawing Sheets

CIGARETTE AERATION AND FILTRATION DEVICE

CROSS REFERENCE TO RELATED APPLICATION

This application is based on Provisional Patent Application Ser. No. 60/069,229, filed Dec. 11, 1997.

BACKGROUND OF THE INVENTION

1. Field of the Invention

The present invention relates to a cigarette aeration and filtration device. More specifically, a device that is capable of being inserted into a cigarette. Even more particularly, the present invention relates to a device that is meant to be reusable.

2. Description of the Prior Art

It is known to provide cigarettes with ventilation features, which function during the course of smoking the cigarette, to admit certain quantities of diluting streams of air for the purpose of effecting a concomitant reduction in the delivery of particulate matter in the smoke stream. This particulate matter is commonly called "tar" and also produces a nicotine, both of which are injurious to the health of the smoker. It is also known that the concentration of undesirable smoke constituents can be reduced, if provision is made to make the combustion more complete and/or to dilute and cool the smoke by the supply of secondary air. In most cigarettes, the tar delivered to the smoker by a cigarette increases puff by puff as the cigarette is consumed. This occurs in a standard cigarette as air enters the cigarette through the porous paper wrapper, thereby diluting the smoke and subsequently reducing the tar that reaches the smoker. However, as the cigarette becomes shorter, the dilution of the smoke stream by air is reduced since less of the porous paper wrapper is available to provide dilution. It is highly desirable to increase the supply of air as the cigarette burns down. In the past, many inventions have been made to filter cigarette particulate matter. One common method was the use of cigarette holders. Their popularity has waned, or perhaps has never been too successful because of the esthetics. Everyone is aware of the dangers related to smoking cigarettes and there are solutions proposed every day to reduce the dangerous particulate matter. In order for an effective solution, that solution must be cost effective. The prior art proposes numerous solutions for solving this problem, but in many cases they have not proven to be cost effective.

U.S. Pat. No. 4,972,856, which issued to Nazzaro Sergio on Nov. 27, 1990, discloses a cigarette filter suitable for being fitted in a cigarette. The entire filter is inserted within the cigarette and, when inserted, it not visible as the smoker uses it. Sergio does teach that the filter can be removed and used again in other cigarettes. The inserted portion contains a conically shaped part with a plurality of holes therein. The main features of this invention are that it provides a filter, is reusable and is secretly used. It does not seem to offer a solution to the need of a secondary air supply to the cigarette as it burns down.

U.S. Pat. No. 3,773,053 which issued to William K. Stephens, Jr., on Nov. 20, 1973, discloses a means for controlling the ventilation of air by a plurality of elongated channels. These channels are longitudinally coextensive with the tobacco cylinder and are each crimped at their smoking end and become open as the cigarette burns down. The solution to supplying air in greater quantities as the cigarette becomes shorter is addressed, however, it is achieved entirely by manufacturing the channels using combustible materials. There is no reusable feature and the overall manufacturing costs should be much greater as a result.

U.S. Pat. No. 3,774,622, which issued to Karl Heinz Steigerwald on Nov. 27, 1973, teaches a method of introducing secondary air along with ambient air to aid in making combustion more complete. This is accomplished by not only diluting the air but by also cooling it. In standard cigarettes the air is introduced through the wrapper and then intermingles with the still hot smoke thereby cooling the smoke. This will cause an increased proportion of the smoke constituents to be condensed out of the smoke before the smoke passes through the unburnt remainder of the cigarette cord. Since the flow velocity of this secondary air is very small, it is rapidly distributed in the cord material and thus cannot reach the innermost ranges of the cord. This is most unfortunate because this is where the largest oxygen deficit exists. Steigerwald discloses a secondary channel to help offset this problem. This secondary channel is introduced nearer the mouth end of the cord, with the connection being separated from the suction path. By this separate ambient air connection, secondary air can enter the channel without having to pass the combustion zone. This allows it to arrive with its full oxygen content and still in a comparatively cold condition at the inner ranges of the combustion zone. This invention appears to offer a good means of introducing cool air, but it obviously would involve extremely higher manufacturing costs, since it is not a reusable solution as is the present invention.

Another method of introducing fresh air is taught in the U.S. Pat. No. 3,756,249, which issued to William A. Selke et al. on Sep. 4, 1973. He uses a longitudinally extending tube which serves as a passageway for air during smoking. While the tube extends the full length of the cigarette cord, the air flow passage is obstructed by crimping the tube. The tube is less crimped as the cigarette burns down, thus addressing the need for more air as the cigarette becomes shorter. The tube itself disintegrates since it is made of combustible materials. Once again the solution lies within the manufacture of the cigarette and does not suggest a solution which teaches a reusable device.

U.S. Pat. No. 3,905,377, issued to George Yatrides on Sep. 16, 1975, discloses an air internal conduit with the main purpose of reducing the toxicity of the smoke to the user. This is accomplished by simultaneously increasing the quantity of external fresh air while increasing the condensation of the toxic vapor. By having an air-permeable duct extending longitudinally from the lit end and terminating at a distance from the suction end in a fluid-impervious end wall, the incoming fresh air is forced to pass through the shredded tobacco. As in the above prior art, this invention does not disclose a reusable device.

None of the above inventions and patents, taken singly or in combination, is seen to describe the instant invention as claimed.

SUMMARY OF THE INVENTION

The cigarette aeration and filtration device of the present invention comprises, at one end a cylindrical rod which extends longitudinally from and is integral with a filter element at the other end. The device is designed for easy insertion of the rod into a cigarette having a preformed conduit therein. The smoking end of the rod will be open and air will be drawn into it by suction. The rod will further have a plurality of holes, whereby the air will intermingle with the shredded tobacco. The quality of taste desired by the smoker will be a direct function of the size and number of holes. As the cigarette burns, the amount of air intake will increase, thus offsetting the larger amount of particulate matter that is present as the cigarette becomes shorter. This particulate matter being nicotine, carbon monoxide, tar and tar after products. The mouth end of the device will have a filtering element. In the present invention, this filter will include from one to three filtering rings.

Accordingly, it is a principal object of the invention to provide an effective device for allowing an increased flow of fresh air to the user as the cigarette is consumed, thus reducing the overall percentage of particulate matter to the smoker.

It is another object of the invention to provide a filter element whose filtering strength can be selectively chosen by the smoker. This will allow the smoker to determine the level of particulate matter that he is willing to absorb for the sake of taste. This will be a valuable tool in the difficult process of weaning off cigarettes those people who are addicted to them.

It is a further object of the invention that the device be totally independent of the cigarette. The device itself will be the sole source of aeration and filtration. The cigarette need only be made with a cylindrical and longitudinally extending conduit for the easy insertion of the rod.

It is still the main objective of the invention, that it be a system designed to reduce the incidence of disease, as well as hopefully weaning people off the smoking of cigarettes in a progressive manner and at a risk level they themselves choose. The rod and filter will be available in various levels for controlling the particulate matter to the smoker, so that in time he/she will be able to wean themselves from the habit. The user will also be able to control the strength of the filter by being able to select the desired number of filtering rings.

It is an object of the invention to provide a useful device that is reusable, inexpensive, dependable and fully effective in accomplishing its intended purpose.

These and other objects of the present invention will become readily apparent upon further review of the following specification and drawings:

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
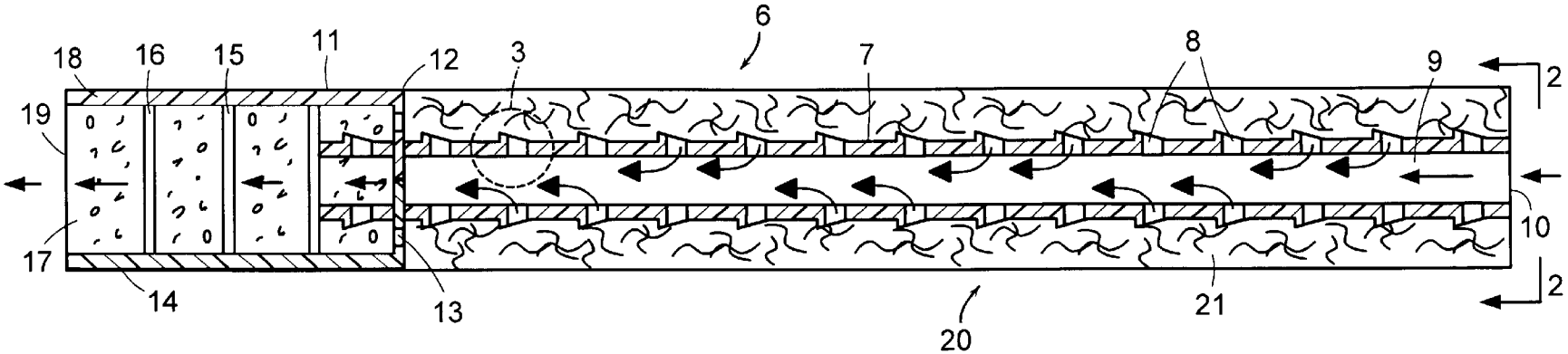
FIG. 1 is a longitudinal, cross-sectional view of the device when it is fully inserted into the open channel of the cigarette.
Figure 3:
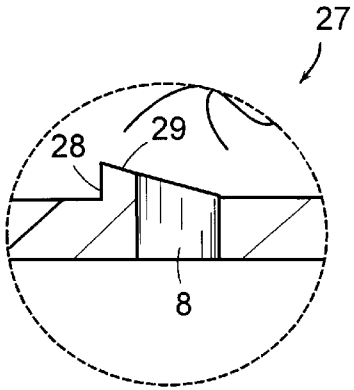
FIG. 3 is a detailed view of the ridge with the ventilation deposed therein.
Figure 2:
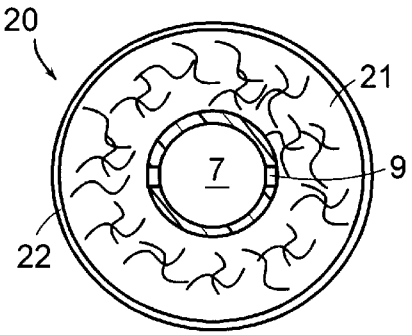
FIG. 2 is an end view of the present invention as it is seated in the cigarette.
Figure 5:
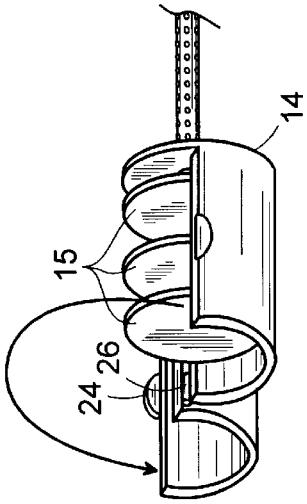
FIG. 5 is perspective view of the filter rings as they are seated in the respective slots within the filter element.
Figure 4:
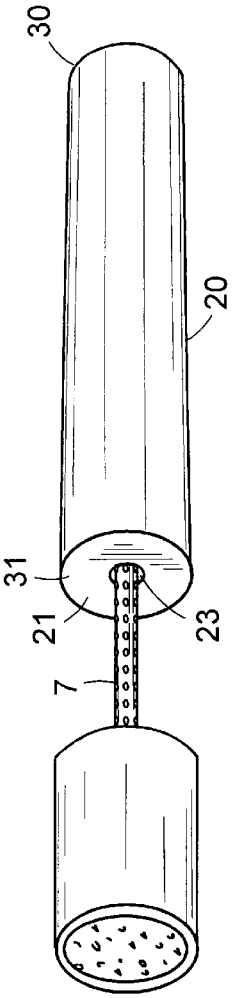
FIG. 4 is an expanded view of the device as it is inserted into a cigarette cord.

The present invention relates generally to the reduction in the quantity of total particulate matter delivered during the smoking of a cigarette, and specifically increasing the ratio of ventilation as the cigarette is smoked. Referring now to the figures by numerals of reference, and first to FIG. 1, 6 denotes generally to an aeration and filtration device of the present invention, which is shown to be insertable within a cigarette cord 20. The device 6 generally comprises at one end a filter element 14 which is cylindrical in shape and has at one end a flange 12. Integral with and extending longitudinally from the flange 12 is a cylindrial rod 7. FIGS. 1 and 5 show the filter element 14 having opposite ends constituting, respectively, an intake end and the flange. Deposed within the filter element are a plurality of filtering slots 16 which can accept a plurality of filtering rings 15, the number of these rings 15 being a choice of the user. The more rings 15, the greater the protection to the smoker. The selection of filtration strength is seen as a means for weaning a smoker away from the addiction of nicotine. The filter 14 will have a fill 17 that is standard in the industry such as a fibrous or foamed material. The filter 14 will have a wrapping comprising a porous filtering paper 18. The flange 12 which is integral with the filter 14 on one side and the rod 7 on the other side is concentrical with a surface area surrounding the rod 7. The surface area has a plurality of intake holes 13 which serve to help the smoke stream enter the filter element. The rod 7 includes a plurality of ridges 27. FIG. 3 shows each ridge 27 having a vertical wall 28 which serves to keep the device 6 in place. In addition each ridge 27 has a slanted surface 29 with a ventilation hole 8 defined therein. The number of these holes 8 can be varied by the manufacturer depending on the selection by the smoker. The rod 7 will be made from a lightweight material that will neither burn nor be hazardous to the health of the smoker. The rod 7 will be hollow and will have an internal surface defining an air passage channel 9 extending the entire length of the rod 7, from the smoking end 10 to the suction end 11 which terminates within the filter 14. Referring to FIGS. 1 and 4, there is depicted a cigarette cord 20 constructed in accordance with the principles of the present invention and wherein the cigarette 20 includes an elongated cylinder of shredded tobacco 21 which in usual manner is enclosed in a cylindrical wrapping of paper 22, the latter being the conventional combustible type paper wrapping used in making cigarettes. The cigarette 20 has opposing ends, a lit end 30 and a mouth end 31. Deposed and longitudinally extending within the cigarette 20 is a conduit 23 which is preformed and made from some suitable material such as reconstituted tobacco products. The device 6 is inserted into a cigarette 20 by pushing the rod 7 through the preformed conduit 23 at the mouth end 31 of the cigarette 20. According to FIG. 2 the conduit 23 separates the rod 7 from the shredded tobacco 21. When inserted in a cigarette 20, the device 6 does not need any unesthetic cigarette holders. This should prove cost effective and would be more likely acceptable to the younger generation of smokers. It will also be more healthful than using holders which have been proven to be unhealthy, possibly contributing to cancer of the lips. In the preferred embodiment, the device 6 is reusable and and will be manufactured and sold in various levels of filter strength. The outer diameter of the rod 7 can be varied which will therefore change the amount of tobacco in the cord 20. By varying the amount of tobacco the smoker has another option for helping him/her to wean off the use of cigarettes.

An optional embodiment is disclosed in FIG. 5 wherein the filter element 14 can be supplied with a snap opening portion 24 which can be opened by rotating about a pair of hinges 26. This will allow the smoker with the option of choosing the quantity of rings and thereby the level of filtering strength he so desires.

Figure 6:
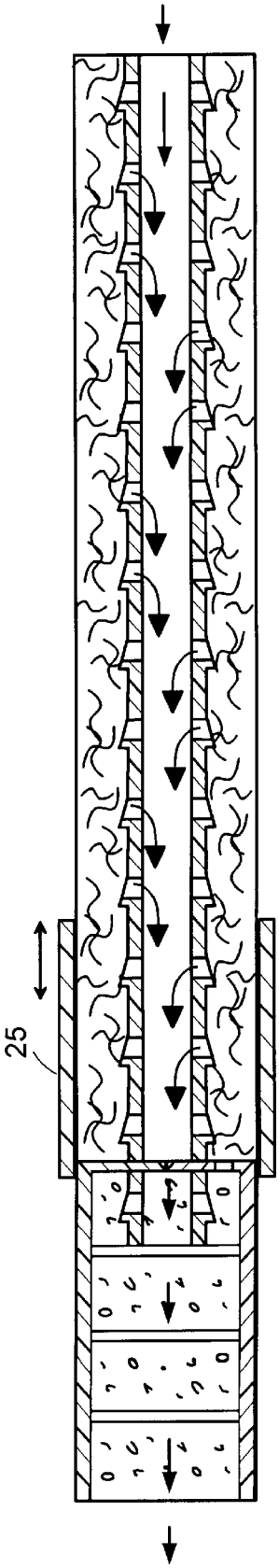
FIG. 6 is a longitudinal, cross-sectional view showing the finger rest element.

Another optional embodiment is shown in FIG. 6 whereby the device 6 also includes a finger rest 25. This finger rest 25 extends longitudinally from the flange and has a cylindrical surface 12 defining an opening 32 therein which is just large enough to slide over the mouth end 31 of the cigarette cord 20. This finger rest 25 is also a good indicator as to where the user should stop smoking the cigarette, as it is well known that the end of the cigarette is the most dangerous. A side effect of the finger rest 25 is to eliminate the nicotine stains that tend to darken the fingers of the habitual smoker.

Accordingly, the present invention has for its object a reduction in the vapors by directing the intake air that is sucked into the air passage channel 9 then dissipated through the shredded tobacco 21 via the ventilation holes 8, thereby making it possible to significantly reduce the temperature of the smoke vapor and consequently reducing the toxic content thereof. This reduction of toxicity is caused by the cool air intermingling with the smoke thus causing some condensation. Since the condensation is heavier than the smoke this will cause the particulate matter to drop from the smoke. The invention also reduces the nicotine content by a series of filter rings. The condensation will make it easier for the nicotine and tar to adhere to the filtering rings. Since the intaking air to the smoker is cooled significantly, the resulting smoke will be milder and mellower.

The present invention also acknowledges that it may be practical to separate the cigarette cord from the rest of the invention as that could be a manufactured item that would be sold completely separate from the rest of the invention.

It will be understood that this invention may be used in connection with cigars as well as cigarettes.

It is to be further understood that the present invention is not limited to the sole embodiment described above, but encompasses any and all embodiments within the scope of the claims.

I claim:

1. A cigarette aeration and filtration device comprising:

an elongated cigarette cord having a mouth end and a lit end, a preformed air permeable conduit longitudinally and coextensively deposed within the cord, the cord having a concentric core of shredded tobacco encircling the conduit, a porous paper wrapping the entire lateral surface of the cord;

an elongated cylindrical rod having an outside diameter being substantially equal to the diameter of the preformed conduit of the cigarette cord, the rod being inserted into the preformed conduit, the preformed conduit separating the rod from the shredded tobacco, the rod having a smoking end and a suction end, the cylindrical surface of the rod defining a plurality of ventilation holes evenly dispersed along the length of the rod, the rod being hollow with an internal surface defining an air passage channel extending the entire length of the rod and being coaxial with the cigarette cord, whereby air, being cooler than the smoke stream causes both condensation and reduced toxic content, is sucked into the air passage channel through both the smoking end of the rod and the ventilation holes, is dissipatable through the shredded tobacco; and a filter element integral with the suction end of the rod, the filter element having a fill of fibrous material, a porous paper wrapper concentrically covering the filter element, one end of the filter element being an air intake and the other end a flange, the flange having an outside diameter at least equal to the diameter of the cigarette cord, the flange serving to seal the filter element and the cigarette cord, the flange having a face surface defining a plurality of intake holes for directing the smoke stream through the filter element, whereby the condensation in the smoke stream will cause the particulate matter to drop out and deposit in the tobacco and fill matter thereby creating a cleaner and healthier smoke stream that enters the user's lungs.

2. The device as defined in claim 1 wherein the conduit is made from reconstituted tobacco products.

3. The device as defined in claim 1 wherein the porous paper wrapper is a conventional combustion type paper.

4. The device as defined in claim 1, wherein the rod is made from a lightweight material that will neither burn nor be hazardous to the health of the smoker and will be reusable.

5. The device as defined in claim 1, wherein each ventilation hole further includes a ridge, each ridge having a vertical wall for stabilizing the rod within the cigarette cord, the ridge further having a slanted surface, the slanted surface defining the ventilation hole therein, such that as the cigarette burns the air intake is increased to compensate for the greater percentages of particulate matter present in the remaining cigarette cord.

6. The device as defined in claim 1, wherein the filter element further includes a plurality of concentric filter slots defined within the inner surface of the filter element, with a plurality of concentric filter rings deposed within the slots, the number of rings being a function of choice by the user, whereby the larger the number of rings, the better the device will filter the nicotine and tars which are condensed from the smoke stream.

7. The device as detailed in claim 6, the filter element having an opening means whereby the user may have access to the interior of the filter element for changing, replacing, cleaning, reducing or increasing the number of rings.

8. The device as detailed in claim 7, wherein the opening means of the filter element being a snap opening port rotatable about a pair of hinges.

9. The device as detailed in claim 1, wherein the device further includes a concentric finger rest extending longitudinally from the flange and having a cylindrical surface defining an opening therein, the opening just large enough to slide over the mouth end of the cigarette cord thereby increasing the support of the cigarette cord.

10. A cigarette aeration and filtration device comprising:

an elongated cigarette cord having a mouth end and a lit end, a preformed air permeable conduit longitudinally and coextensively defined by a surface made from reconstituted tobacco products, the cord having a concentric core of shredded tobacco encircling the conduit, a porous paper made from conventional combustion type paper wrapping the entire lateral surface of the cord;

a reusable elongated cylindrical hollow rod having an outside diameter being substantially equal to the diameter of the preformed conduit of the cigarette cord, the rod being inserted into the preformed conduit, the preformed conduit separating the rod from the shredded tobacco, the rod being made from a lightweight material that will neither burn nor be hazardous to the health of the smoker includes a smoking end and a suction end, the cylindrical surface of the rod having a plurality of ridges evenly dispersed along the length of the rod, each ridge having a vertical wall for stabilizing the rod within the cigarette cord and a slanted surface having defined therein a ventilation hole, the rod having an internal surface defining an air passage channel extending the entire length of the rod and being coaxial with the cigarette cord, thereby air being sucked into the air passage channel through both the smoking end of the rod and the ventilation holes is then dissipated through the shredded tobacco whereby the air being cooler than the smoke stream causes both condensation and reduced toxic content thereof; and a filter element integral with the suction end of the rod, the filter element having a fill of fibrous material, a porous paper wrapper concentrically covering the filter element, one end of the filter element being an air intake and the other end a flange, the flange having an outside diameter at least equal to the diameter of the cigarette cord, the flange having a face surface defining a plurality of intake holes for directing the smoke stream through the filter element whereby the condensation in the smoke stream will cause the particulate matter to drop out and deposit in the tobacco and fill matter thereby creating a cleaner and healthier smoke stream entering the user's lungs.

11. The device as defined in claim 10, wherein the filter element further includes an opening means, a plurality of concentric filter slots defined within the interior surface of the filter element, and a plurality of concentric filter rings capable of being fitted within the slots, thereby the user may vary his level of filtration.

12. The device as detailed in claim 11, wherein the opening means comprises a snap opening port rotatable about on a pair of hinges.

13. The device as detailed in claim 10, wherein the device further includes a concentric finger rest extending longitudinally from the flange and having a cylindrical surface defining an opening therein, the opening just large enough to slide over the mouth end of the cigarette thereby increasing the support to the cigarette cord.

14. A cigarette and aeration device for use with a cigarette having a preformed conduit, the device comprising:

an elongated cigarette cylindrical rod having an outside diameter being substantially equal to the diameter of the preformed conduit of the cigarette, the rod being inserted into the preformed conduit, the rod having a smoking end and a suction end, the cylindrical surface of the rod defining a plurality of ventilation holes evenly dispersed along the length of the rod, the rod being hollow with an internal surface defining an air passage channel extending the entire length of the rod and being coaxial with the cigarette, thereby, air sucked into the air passage channel through both the smoking end of the rod and the ventilation holes, is dissipated through the cigarette whereby the air, being cooler than the smoke stream causes both condensation and reduced toxic content thereof; and a filter element integral with the suction end of the rod, the filter element having a fill of fibrous material, a porous paper wrapper concentrically covering the filter element, one end of the filter element being an air intake and the other end a flange, the flange having an outside diameter at least equal to the diameter of the cigarette, the flange serving to seal the filter element and the cigarette, the flange having a face surface defining a plurality of intake holes for directing the smoke stream through the filter element whereby the condensation in the smoke stream will cause the particulate matter to drop out and deposit in the cigarette and fill matter thereby creating a cleaner and healthier smoke stream that enters the user's lungs.

15. The device as defined in claim 14, wherein each ventilation hole further includes a ridge, each ridge having a vertical wall for stabilizing the rod within the cigarette, the ridge having a slanted surface, the slanted surface defining the ventilation hole therein, such that as the cigarette burns the air intake increases to compensate for the greater percentages of particulate matter present in the remaining cigarette.

16. The device of claim 15, wherein the rod is made from a lightweight material that will neither burn nor be hazardous to the health of the smoker and will be reusable.

17. The device as defined in claim 16, wherein the filter element further includes a plurality of concentric filter slots defined within the inner surface of the filter element, with a plurality of concentric filter rings deposed within the slots, the number of rings being a function of choice by the user, whereby the larger the number of rings the better the device will filter the nicotine and tars which are condensed from the smoke stream.

18. The device as detailed in claim 17, the filter element having an opening means whereby the user may have access to the interior of the filter element, for changing, replacing, cleaning, reducing or increasing the number of rings.

19. The device as detailed in claim 18, wherein the opening means of the filter element being a snap opening port rotatable about a pair of hinges.

20. The device as detailed in claim 14, wherein the device further includes a concentric finger rest extending longitudinally from the flange and having a cylindrical surface defining an opening therein, the opening just large enough to slide over the mouth end of the cigarette.

* * * * *